US005660393A

United States Patent [19]

Dreger

[11] Patent Number: 5,660,393

[45] Date of Patent: Aug. 26, 1997

[54] METHOD OF PLAYING A CARD-BASED WAGERING GAME

[76] Inventor: Kurt Dreger, 1616 Portland Ave., Savanna, Ill. 61074

[21] Appl. No.: 680,444

[22] Filed: Jul. 15, 1996

[51] Int. Cl.[6] ..... A63F 1/00

[52] U.S. Cl. ..... 273/292; 273/274

[58] Field of Search ..... 273/292, 274, 273/309; 463/13, 12

[56] References Cited

U.S. PATENT DOCUMENTS

| | | | |
|---|---|---|---|
| 5,019,973 | 5/1991 | Wilcox et al. | 463/13 |
| 5,098,107 | 3/1992 | Boylan et al. | 273/292 |
| 5,288,081 | 2/1994 | Breeding | 273/292 |
| 5,322,295 | 6/1994 | Cabot et al. | 273/292 |
| 5,382,025 | 1/1995 | Sklansky et al. | 273/292 |
| 5,417,430 | 5/1995 | Breeding | 273/292 |
| 5,431,407 | 7/1995 | Hofberg et al. | 273/292 |
| 5,437,451 | 8/1995 | Fulton | 463/13 |
| 5,437,462 | 8/1995 | Breeding | 273/292 |
| 5,454,570 | 10/1995 | Karal | 273/292 |
| 5,531,448 | 7/1996 | Moody | 273/292 |

*Primary Examiner*—Benjamin H. Layno
*Attorney, Agent, or Firm*—Ian F. Burns

[57] ABSTRACT

A card-based wagering game with multiple wagers is disclosed. Players may place two wagers on a five card poker hand as well as a wager on the occurrence of a card within a range of cards. Three cards are dealt to the dealer and two cards are dealt to each player. The dealer then reveals each of his cards in turn. If the first dealer card falls within the range of cards selected by the player, the player wins this wager. After the dealer reveals his second card, the player may withdraw the second wager on the player's poker hand. When all of the dealer's cards are revealed, each player's poker hand is formed by combining the dealer's cards with the player's cards. The players' hands are then resolved according to a pay table.

9 Claims, 5 Drawing Sheets

METHOD OF PLAYING A CARD-BASED WAGERING GAME

BACKGROUND OF THE INVENTION

1. Field of Invention

The present invention relates to a card-based wagering game which includes means for wagering on the occurrence of a particular card or the occurrence of a card within a range of cards in addition to means for wagering on a poker hand.

2. Description of Related Art

Card-based wagering games are well known in the art. Many different games have been developed and many variations of traditional card games, such as poker, have also been developed. Some examples of card-based wagering games can be found in U.S. Pat. No. 5,288,081 to Breeding, U.S. Pat. No. 5,382,025 to Sklansky et al., U.S. Pat. No. 5,437,462 to Breeding, and U.S. Pat. No. 5,454,570 to Karal. However, the games disclosed in these references fail to provide a means whereby a player may wager on the occurrence of a particular card or the occurrence of a card within a range of cards. Many players enjoy wagering on the occurrence of a single random or near random event. This is demonstrated by the popularity of games such as roulette, keno, lotteries, and craps in which a player may place a wager on a number or range of numbers. Many players are intrigued and excited by attempting to guess the outcome of a single event random game.

From a casino's or house's point of view, single event wagering games are desirable because these games are highly profitable. Many players are attracted to this type of game and the average wager is high. Furthermore, single event random games can be inexpensive to administer, especially if they can be integrated into other games.

SUMMARY OF INVENTION

1. Objects of the Invention

It is an object of the invention to provide a card-based wagering game which includes means for wagering on the occurrence of a single random event.

It is a another object of the present invention to provide an entertaining wagering game which may be played in a casino or other location.

It is another object of the present invention to provide an exciting and interesting wagering game that is easy to learn, and is based on well known poker hands and ranking of poker hands.

It is another object of the present invention to provide a wagering game based on five card poker which includes means for wagering on a single random event.

A further object of the invention is to provide a wagering game which is flexible and allows a house or casino to change the payout of the game to achieve maximum income.

Another object of the invention is to provide increased profit to casinos over prior art games by requiring few cards dealt per game and decreasing the time required for each game.

2. Brief Description of the Invention

In accordance with the above objectives, the present invention may be based on a table or in an electronic device, such as a video gaming machine. The game may be played in almost any setting, but it is especially well adapted to casinos. Each game begins with the players placing a number of wagers. At least two of the wagers are called hand-wagers and will be resolved based upon the player's final poker hand. However, at least one of the hand-wagers may be withdrawn during the course of a game. Each player may also place a card-wager on a range of possible cards, a particular card of any suit, any card of a particular suit, a particular card of a particular suit, or any combination of the above. In the preferred embodiment of the invention, three separate ranges are provided. The first range represents card values six or lower. The second range includes cards seven, eight, and nine. The third range represents cards ten or higher with jacks being eleven, queens being twelve, kings being thirteen, and aces being fourteen. In the preferred embodiment, the second range pays two to one while the first and third ranges pay one to one. Many variations are possible in the ranges, number of ranges, and pay ratios.

Once the players have placed their bets, the dealer will deal two cards to each player and three to himself. All of the cards are dealt face down so that the players will not be able to see their values. The dealer will then turn his first card over to reveal its value. The value of the dealer's first card will determine the outcome of the card-wager. If the dealer's first card falls within the range or ranges selected by the player, the player will win. If the dealer's first card falls outside of the range or ranges selected by the player, the player will lose and the dealer will collect the player's wager.

After the dealer has paid or collected all of the card-wagers, the dealer will reveal the second dealer card. At this point, each player will have the option of withdrawing his second hand-wager or letting the hand-wager continue. Each player may make this decision based upon the four cards, two player cards and two dealer cards, that are known to the player.

Once each of the players has made a decision regarding the second hand-wager, the dealer will reveal his third and final card and proceed to resolve each of the player's wagers. If a player has a winning hand, that player may be paid according to a pay table.

A second embodiment of the invention allows players to place three hand-wagers. The second and third hand-wagers may be withdrawn by the player during the course of the game. After the dealer has dealt the cards and revealed his first dealer card, the card-wagers will be resolved and each player will have the option of withdrawing the third hand-wager. At this point, the players know three of the five cards that will make up their final poker hand. After each player has made a decision whether or not to withdraw the third hand-wager, the dealer will reveal the second dealer card. Each player will then have an opportunity to withdraw their second hand-wager. At this point each player knows four of the five cards which will make up his final poker hand. Once each player has made his decision, the dealer will reveal the third and last dealer card and will proceed to resolve each player's hand. The players may be paid according to a standard poker pay table.

BRIEF DESCRPTION OF THE DRAWINGS

Figure 1:
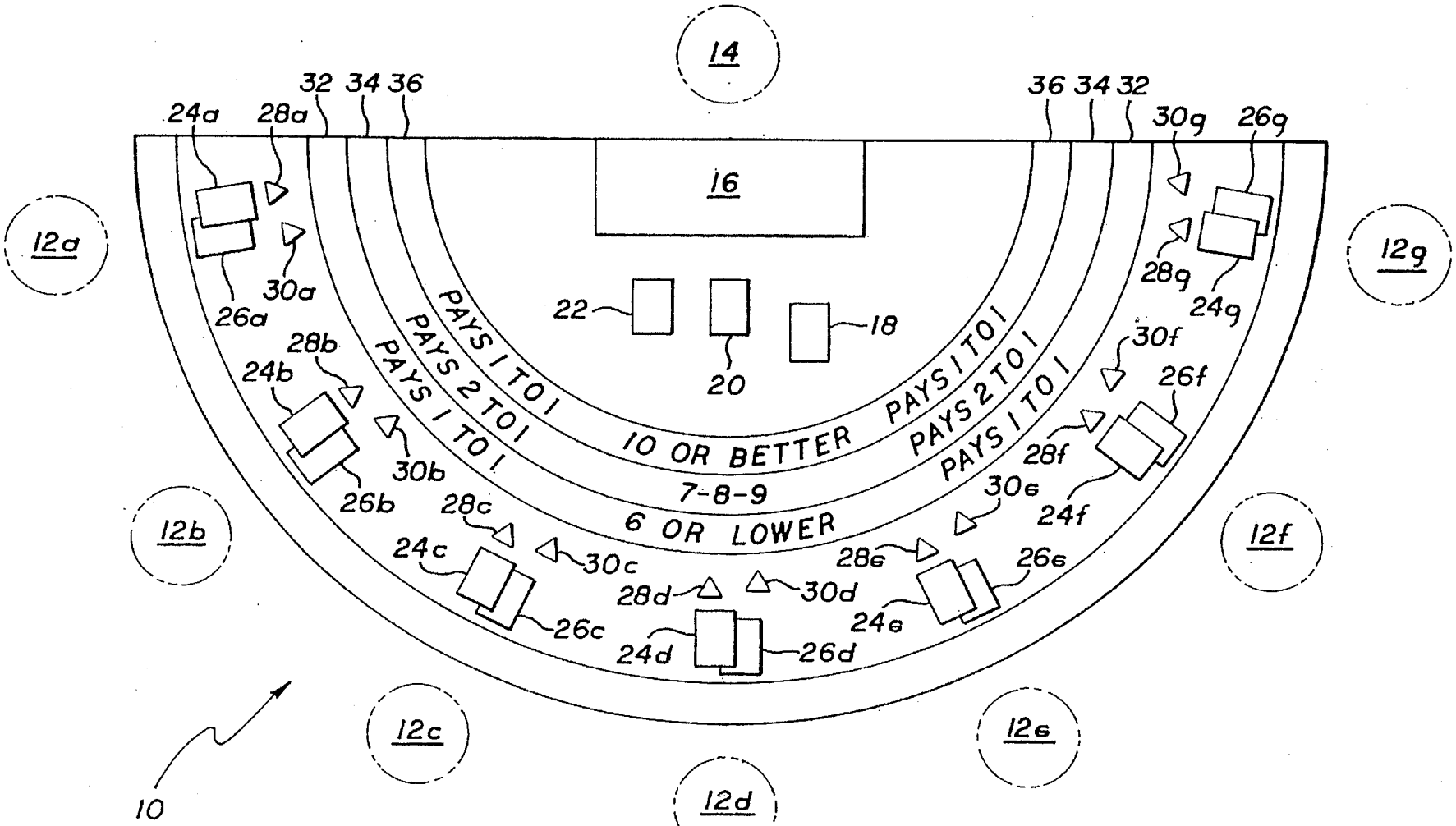
FIG. 1 is a top view of a table layout of one embodiment of the game of the invention.

| REFERENCE NUMERALS | |
|---|---|
| 10 | table |
| 12a–g | player position |
| 14 | dealer position |
| 16 | chip area |
| 18 | dealer card area |
| 20 | dealer card area |
| 22 | dealer card area |
| 24a–g | player card area |
| 26a–g | player card area |
| 28a–g | hand-wager position |
| 30a–g | hand-wager position |
| 32 | card-wager region |
| 34 | card-wager region |
| 36 | card-wager region |
| 40 | decision block |
| 42 | block |
| 44 | decision block |
| 46 | block |
| 48 | block |
| 50 | decision block |
| 52 | block |
| 54 | block |
| 56 | block |
| 58 | decision block |
| 60 | block |
| 62 | block |
| 70 | table |
| 72a–g | player position |
| 74 | dealer position |
| 76 | chip area |
| 78 | dealer card area |
| 80 | dealer card area |
| 82 | dealer card area |
| 84a–g | player card position |
| 86a–g | player card position |
| 88a–g | hand-wager position |
| 90a–g | hand-wager position |
| 92a–g | hand-wager position |
| 94 | card-wager region |
| 96 | card-wager region |
| 98 | card-wager region |
| 110 | block |
| 112 | block |
| 114 | decision block |
| 116 | block |
| 118 | block |
| 120 | decision block |
| 122 | block |
| 124 | block |
| 126 | decision block |
| 128 | block |
| 130 | block |
| 132 | decision block |
| 134 | block |
| 136 | block |
| 138 | block |
| 150 | card-wager region |
| 152 | card-wager region |
| 154 | card-wager region |
| 156 | card-wager region |

DESCRIPTION OF THE PREFERRED EMBODIMENT

As seen in FIG. 1, a standard semicircular casino gaming table 10 may be used to implement the game of the present invention. Table 10 has a playing surface which indicates a number of regions for cards and wagers. The playing surface is preferably colorful felt but many other surfaces may be used. In the preferred embodiment, seven player positions 12*a–g* are indicated on the playing surface near the edge of the table 10. The playing surface may be designed to accommodate any number of players. However, seven players are generally the maximum number which can be efficiently managed by a single dealer. A dealer position 14 is indicated on the flat edge of the table so that the dealer can face each of the players and observe their play.

Dealers position 14 includes a chip area 16 which may be used to store chips, tokens, coins, or bills. Dealers position 14 also includes dealer card areas 18, 20, and 22. When the dealer deals cards, he would place common or dealer cards in these areas. Dealer card area 18 may be slightly removed from dealer card areas 20 and 22 to indicate the special nature of the card dealt to this area. As will be discussed below, the card dealt to dealer card area 18 is used to determine the outcome of each player's optional card-wager.

Each player position 12*a–g* is provided with player card areas 24*a–g* and 26*a–g*. These areas are for receiving player cards when the game is dealt. Each player position 12*a–g* is also provided with two hand-wager positions 28*a–g* and 30*a–g*. At the beginning of each game, each player places hand-wagers in the form of chips, tokens, coins, or bills in these positions. The outcome of the hand-wagers will be based upon the poker hand formed by combining the player's cards with the dealer's cards. Hand-wager positions 28*a–g* and 30*a–g* allow the dealer to clearly see the amount of the hand-wager. In the preferred embodiment, the player may make two separate hand-wagers; the first is required and may not be withdrawn by the player, the second is optional and may be withdrawn by the player at a later stage of the game. In the preferred embodiment, the optional hand-wager must be twice the required wager. It is understood that the number of hand-wagers and their characteristics may be different and still achieve the objectives of the present invention. For example, there could be three hand-wagers and each wager could be any value desired by the player.

Three concentric semicircular card-wager regions 32, 34, and 36 are provided for card-wagers. Each card-wager region 32, 34, and 36 represent a card or range of possible card values. In the preferred embodiment of the invention, card-wager region 32 represents cards with value of six or lower. Card-wager region 34 represents cards with value seven, eight, or nine. Card-wager region 36 represents cards with value ten or higher with jacks being eleven, queens being twelve, kings being thirteen, and aces being fourteen. In the preferred embodiment, card-wager regions 32 and 36 pay one to one and card-wager region 34 pays two to one.

At the beginning of each game, each player would have the option of placing a card-wager on one or more of card-wager regions 32, 34, and 36. The dealer would then deal the cards and would reveal the first dealer card which would be placed on dealer card area 18. The value of the first dealer card would determine if each player's card-wager wins or loses. For example, if a player places a five dollar wager on card-wager region 34, representing card values seven, eight, and nine, and the first dealer card is a seven, the player would win ten dollars. If a player places a five dollar wager on card-wager region 32, representing card values six or lower, and the first dealer card is an ace, the player would lose his wager of five dollars. If a player places a five dollar wager on card-wager region 36, representing ten or higher, and the first dealer card is an ace, the player would win five dollars.

It is understood that the number of card-wager lines and the card values they represent may be changed. For example, there may be only one line representing any range of possible card values. There may also be thirteen card-wager lines with each line representing a single card and there may be a region which represents a particular card of a particular suit, such as the king of hearts or the ace of spades.

Furthermore, the pay ratios of each line may be changed. For example, a line with a small value range may have a pay ratio of three to one while a larger range may have a pay ratio of one to one or even a fractional payout such as one-half to one. It is also understood that the shape of card-wager regions 32, 34, and 36 may be different. Instead of concentric semicircular lines, the card-wager regions may be circular, polygonal, or grid shaped as in a roulette game.

Figure 5:
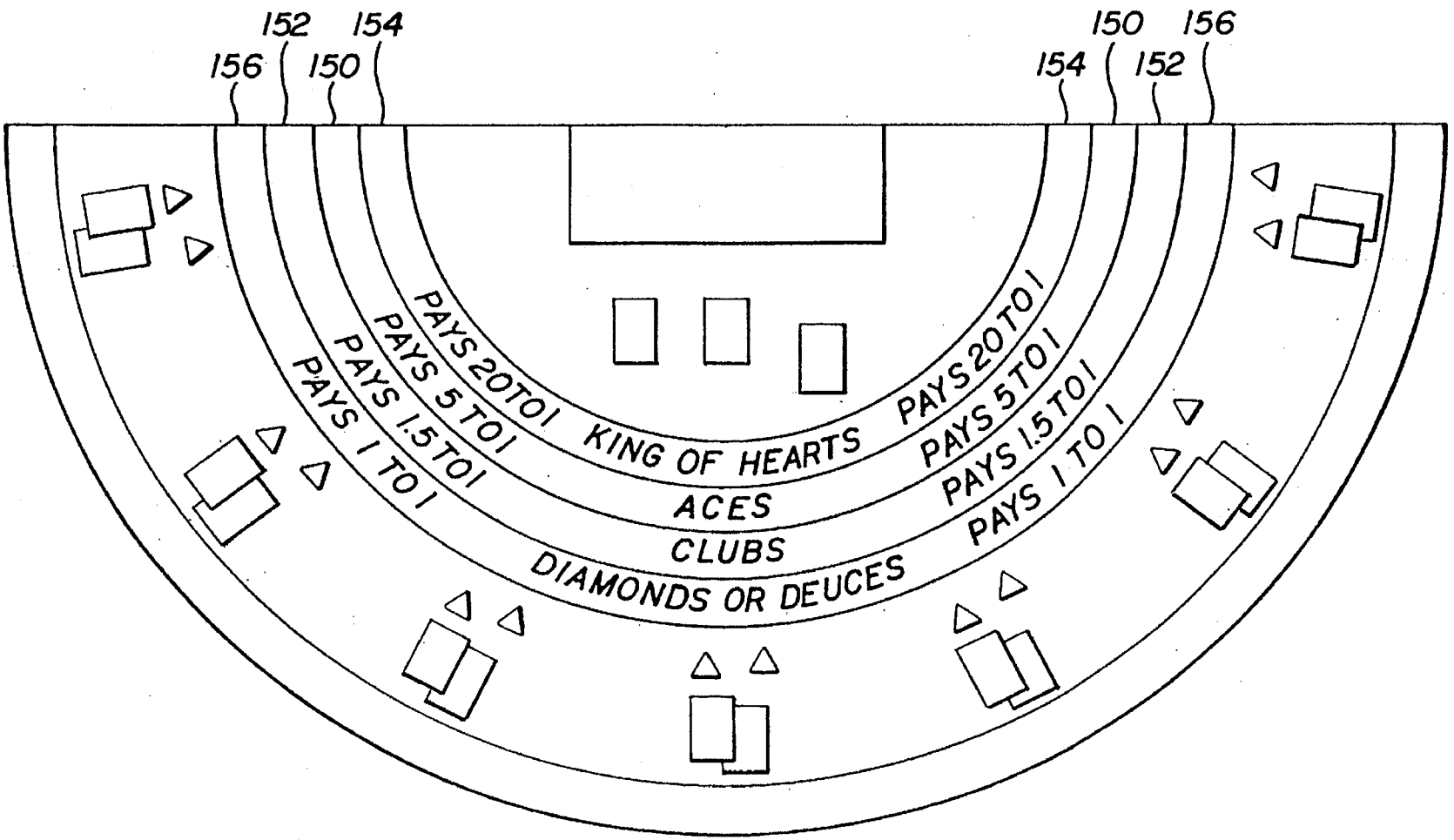
FIG. 5 is a top view of a table showing three card-wager positions, each representing a different range of card values.

FIG. 5 presents one alternative arrangement of the card-wager regions. Card-wager regions 150, 152, 154, and 156 are provided. Card-wager region 150 represents a particular card of any suit, aces, which pays five to one. Card-wager region 152 represents any card in a particular suit, clubs, and pays one and a half to one. Card-wager region 154 represents a particular card of a particular suit, king of hearts, and pays 20 to 1. Card-wager region 156 represents a combination of a suit and a particular card of any suit, diamonds or deuces, and pays one to one.

The card-wagers provide a number of benefits over the prior art. The card-wager regions provide an interesting and entertaining addition to the card game. Unlike games disclosed in prior art references, the card-wagers allow players to wager on the occurrence of a certain card. This is attractive to many players who like to wager on the outcome of a near random event. The wager lines also allows the house to increase income per game. If the card-wager regions are properly arranged with appropriate ranges and payout ratios, the house will have better odds than the players and the house will win in the majority of games. This can greatly increase the house's drop or income.

In addition, the card-wagers provide unparalleled flexibility. The present invention may be changed to produce different payout percentages without confusing players and requiring them to relearn the game. The card-wager regions, ranges, and payout ratios can be designed to achieve many different payout percentages (the average percentage of a wager that is paid to players) yet players can quickly and easily adapt to changes in the game. The players need only read the values and payout ratios indicated on the table or on electronic display to quickly understand this portion of the game. The flexibility of the present invention can be used to prevent players from getting bored with the game. The game may be changed at suitable intervals to maintain player interest.

The present invention also has the advantage that it requires fewer cards than other games. If the table has seven players, the dealer will deal a total of 17 cards. Most other games require more cards. In a traditional poker game, a dealer would deal many more cards. The present invention also requires fewer cards than modified poker games, such as the game disclosed in U.S. Pat. No. 5,437,462 to Breeding which requires 23 cards with seven players. Because the present invention requires fewer cards, it is more profitable to the casino. Fewer cards require less time to deal which results in less time per game. More games can be played in a given time period which increases the casino 's income and profit.

Figure 2:
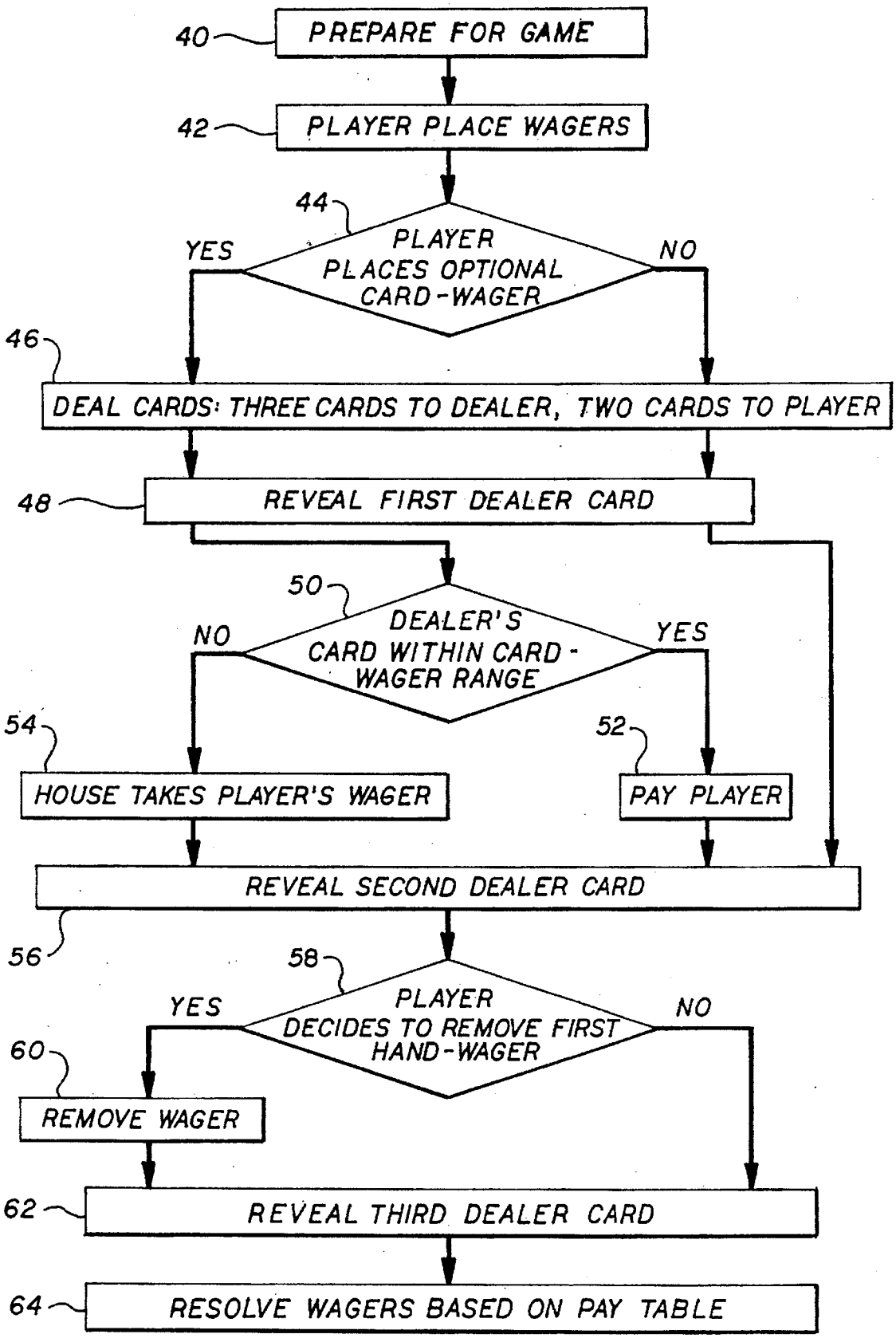
FIG. 2 is a flowchart of one embodiment of the game of the invention.

Turning to the flowchart of FIG. 2, a typical game is begun by preparing for play as represented by block 40. This may include clearing the table of cards and shuffling a deck of cards. The players will then place a wager on hand-wager positions 28*a–g* and 30*a–g*, block 42. At decision block 44 each player must decide whether or not to make a card-wager. If they wish to make a card-wager, the player will place a wager on one or more of card-wager regions 32, 34, and 36, otherwise the player will wait for the dealer to deal the cards. Once all of the players have placed their wagers, the dealer will deal the cards and the cards will be placed face down so that their value is hidden, block 46. In the preferred embodiment, three cards are dealt to the dealer and two cards are dealt to each player. However, other combinations are possible. The dealer's cards are common to each player's hand. Together the dealer's and each player's cards will form a five card poker hand for each player.

In block 48 the first dealer card will be revealed. Alternatively, the first dealer card may be dealt face up so that it is revealed immediately. In decision block 50, the value of the first dealer card is used to determine the outcome of the card-wager if the player placed a card-wager on one or more of card-wager regions 32, 34, and 36. If the dealer's first card falls within the range of values chosen by the player, the player will win and the player shall be paid the appropriate payout, block 52. If the dealer's first card is not in the range of values chosen by the player, the player loses his wager and the house collects the wager, block 54.

Once the card-wagers have been resolved, the dealer will reveal (turn face up) the second dealer card which was dealt to dealer card area 20, block 56. At this point the players have the option to withdraw their second hand-wager which was placed in hand-wager positions 30*a–g*, decision block 58. Each player is permitted to look at their cards which are in player card areas 24*a–g* and 26*a–g*. Therefore, the player knows four out of the five cards which will make up the player's poker hand. If a player determines that the odds of having a winning poker hand are poor, the player will probably withdraw his optional wager, block 60. If a player determines that the odds of having a winning poker hand are good, the player will probably not withdraw his optional wager. Regardless of each player's decision, the players are not allowed to remove their first hand-wager which was placed on hand-wager positions 28*a–g*.

In block 62, the dealer reveals that the third and last dealer card which was dealt to dealer card area 22. At this point the dealer can determine if each player hand is a winning hand and can resolve their wagers. If a player has a winning hand, the player may be paid according to a standard poker pay table. Pay tables are well known in the art and many variations are possible. The following is one possible example:

| Poker Hand | Pay Player |
|---|---|
| Royal Flush | 100-1 |
| Straight Flush | 50-1 |
| 4 of a Kind | 25-1 |
| Full House | 10-1 |
| Flush | 6-1 |
| Straight | 4-1 |
| 3 of a Kind | 3-1 |
| 2 - Pair | 2-1 |
| Pair of 8's or better | 1-1 |

A bonus may also be paid for certain specified hands.

Figure 3:
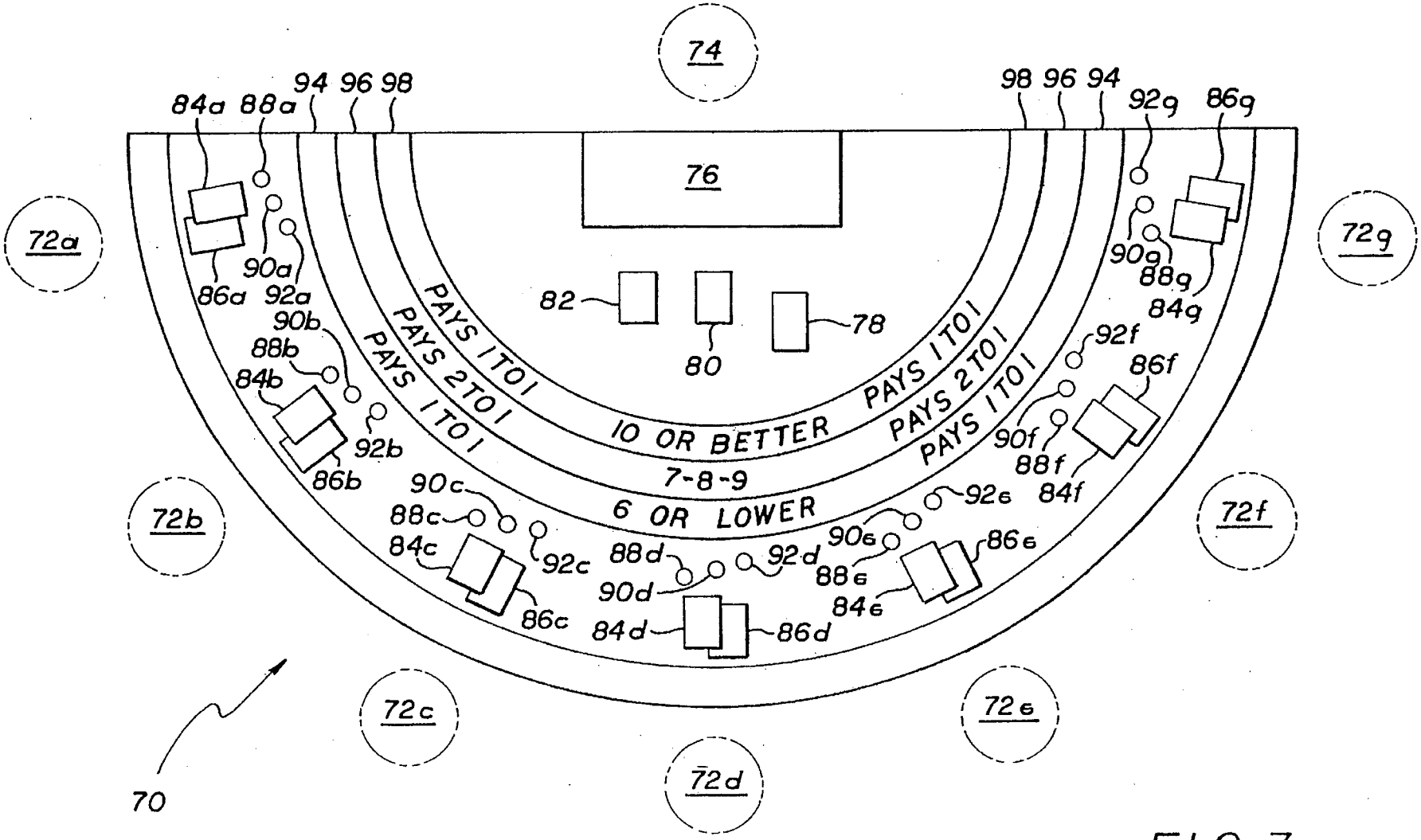
FIG. 3 is a top view of a table layout of a second embodiment of the invention.
Figure 4:
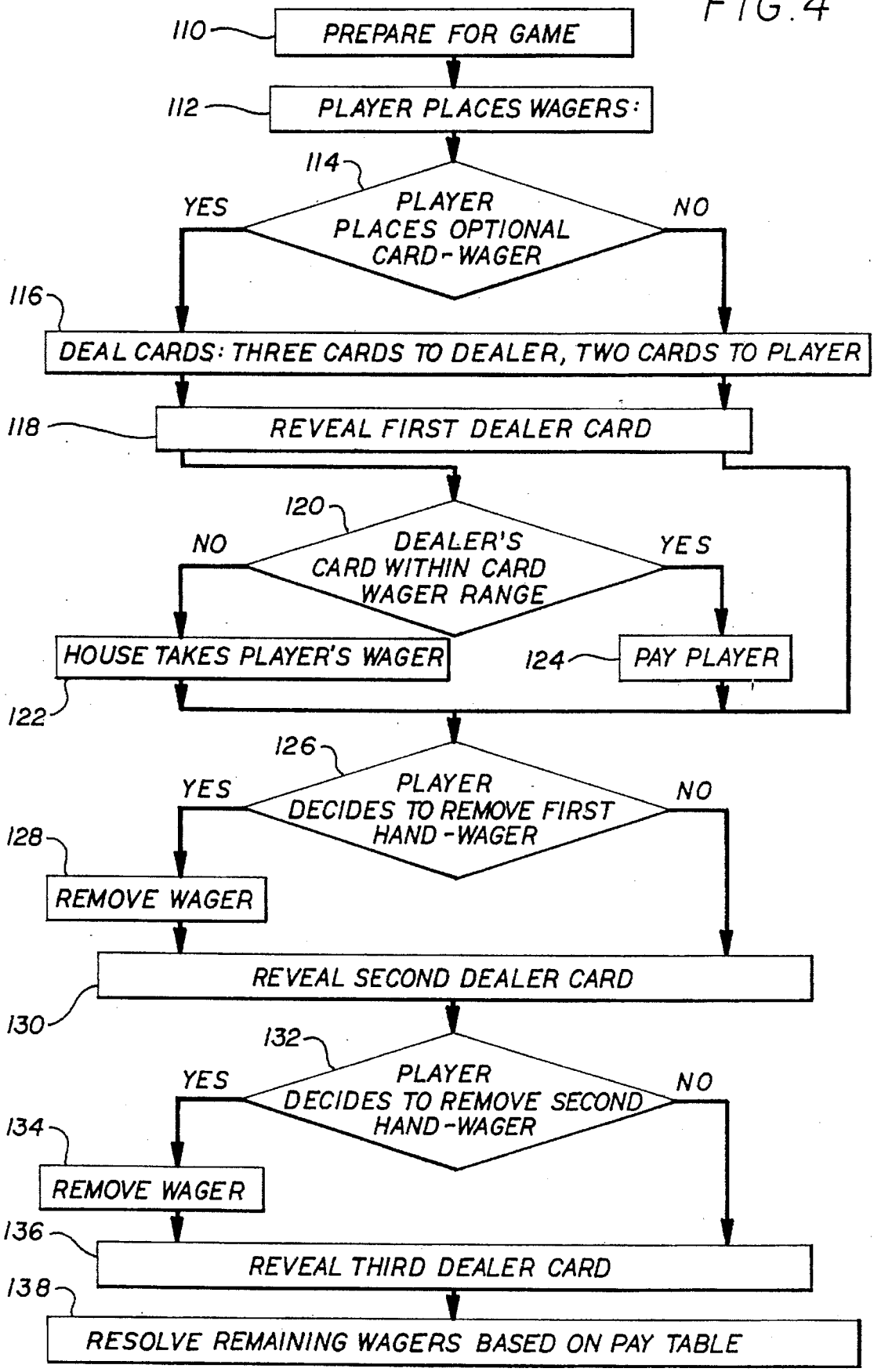
FIG. 4 is a flowchart of a second embodiment of the invention.

FIGS. 3 and 4 disclose a second embodiment of the present invention. This embodiment utilizes a table layout which is similar to the first embodiment discussed in FIGS. 1 and 2. Table 70 is provided with player positions 72*a–g* and dealer position 74. Chip area 76 is provided for the dealer's chips, tokens, coins, or bills. There are three dealer card areas 78, 80, and 82 for receiving the dealer's cards. As in the first embodiment, dealer card area 78 may be slightly removed from card area 80 and 82 to indicate the special nature of the card dealt to this position. This card will be used to determine each player's hand-wager. Each player has two card positions 84*a–g* and 86*a–g* for receiving player cards. Each player also has hand-wager positions 88*a–g*, 90*a–g*, and 92*a–g* for receiving the player's hand-wagers. Card-wager regions 94, 96, and 98 are for receiving each player's optional card-wager. The most significant difference between the first and second embodiments is the presence of an additional hand-wager position. The second embodiment allows each player to place three hand-wagers instead of two.

As seen in FIG. 4, the game of the second embodiment begins by preparing for play. In this stage, the table is cleared of cards and the deck of cards may be shuffled. Each player then places his hand-wagers, block 112, in the second embodiment each player may place up to three wagers, the second and third wagers are optional, but the first wager is required. Each player will then decide whether or not to place a card-wager, block 114. In block 116, the dealer deals the cards which as in the preferred embodiment will be three to the dealer and two to each player. Next, the dealer will reveal the first dealer card which was dealt to dealer card area 78, block 118. The dealer then examines each player's card-wager, if the player placed a card-wager, block 120. If the card dealt to dealer card area 78 fell within the range chosen by the player, the player will be paid, block 124. If the dealer's first card was not within range chosen by the player, the house collects the player's wager, block 122.

At this point, the player will decide whether or not to remove the first hand-wager, block 126. Each player knows his own two cards and can see the first dealer card which was revealed in block 118. Based on the player's own determination of the chances of success, the player may remove the first hand-wager, block 128, or keep it in play. In block 130, the dealer then reveals the second dealer card which was dealt to dealer card area 80. Each player now knows four of the five cards which will make up the player's final poker hand. At this point, each player will decide whether or not to remove the second hand-wager or keep it in play, blocks 132 and 134. The dealer then reveals the third and last dealer card, block 136, and will resolve each of the player's wagers based on a pay table, block 138.

What is claimed is:

1. Method of playing a wagering card game using a standard fifty two card deck comprising the following steps:

(a) each player placing at least a first and second hand-wager, giving each player an option to place at least one card-wager, said card-wager being placed on a range of card values, (b) dealing a first, second, and third dealer card, dealing two player cards to each player, at least said second and third dealer cards being dealt face down whereby the value of said second and third dealer cards is not immediately revealed, (c) revealing said first dealer card, (d) resolving said card-wager for each player who placed a card-wager, said card-wager being paid if said first dealer card is within said range of card values, said card-wager being collected if said first dealer card is outside said range of possible card values, (e) revealing said second dealer card, (f) giving each player the opportunity to examine said player cards and said first and second dealer cards, (g) giving each player a choice to withdraw said second hand-wager, (h) revealing said third dealer card, (i) forming a five card poker hand for each player from each player's said two player cards and said first, second, and third dealer cards, (j) resolving said first and second hand-wagers for each player based on the poker hand ranking of each player's five card hand, said second hand-wager being resolved if said second hand-wager was not withdrawn.

2. The method of claim 1 wherein said second hand-wager is twice the amount of said second hand-wager.

3. The method of claim 1 wherein said first and second hand-wagers are paid according to a predetermined poker pay table.

4. The method of claim 1 wherein the card-wager may be placed on ranges comprising the following:

(a) six or lower, (b) seven, eight, or nine, and (c) ten or higher where jacks, queens, kings, and aces are all higher than ten.

5. The method of claim 4 wherein the ranges in (a) and (c) pay one to one and the range in (b) pays two to one.

6. Method of playing a wagering card game using a standard fifty two card deck comprising the following steps:

(a) each player placing at least a first and second hand-wager, giving each player an option to place at least one card-wager, said card-wager being placed on at least one of the following ranges:

(i) a range of possible card values;

(ii) a particular card of any suit;

(iii) any card of a particular suit;

(iv) a particular card of a particular suit; and (v) a combination of the above ranges, (b) dealing a first, second and third dealer card, dealing two player cards to each player, at least said second and third dealer cards being dealt face down whereby the value of said second and third dealer cards is not immediately revealed, (c) revealing said first dealer card, (d) resolving said card-wager for each player who placed a card-wager, said card-wager being paid if said first dealer card is within said range on which said card-wager was placed, said card-wager being collected if said first dealer card is outside said range on which said card-wager was placed, (e) revealing said second dealer card, (f) giving each player the opportunity to examine said player cards and said first and second dealer cards, (g) giving each player a choice to withdraw said second hand-wager, (h) revealing said third dealer card, (i) forming a five card poker hand for each player from each player's said two player cards and said first, second, and third dealer cards, (j) resolving said first hand-wager and said second hand-wager for each player based on the poker hand ranking of each player's five card hand, said second hand-wager being resolved if said second hand-wager was not withdrawn.

7. Method of playing a wagering card game using a standard fifty two card deck comprising the following steps:

(a) each player placing at least a first, second, and third hand-wager, giving each player an option to place at least one card-wager, said card-wager being placed on a range of card values, (b) dealing a first, second, and third dealer card, dealing two player cards to each player, at least said second and third dealer cards being dealt face down whereby the value of said second and third dealer cards is not immediately revealed, (c) revealing said first dealer card, (d) resolving said card-wager for each player who placed a card-wager, said card-wager being paid if said first dealer card is within said range of card values, said card-wager being collected if said first dealer card is outside said range of possible card values, (e) giving each player the opportunity to examine said player cards and said first dealer card, (f) giving each player a choice to withdraw said third hand-wager, (g) revealing said second dealer card, (h) giving each player a choice to withdraw said second hand-wager, (i) revealing said third dealer card, (j) forming a five card poker hand for each player for each players said two player cards and said first, second, and third dealer cards, (k) resolving said first, second, and third hand-wagers based on the poker hand ranking of each player's five card hand, said second and third hand-wagers being resolved if said second and third hand-wagers were not withdrawn.

8. The method of claim 7 wherein the second and third hand-wager is twice the first hand-wager.

9. The method of claim 7 wherein said range of card values comprises at least one of the following:

(a) a range of possible card values, (b) a particular card of any suit, (c) any card of a particular suit, (d) a particular card of a particular suit, and (e) a combination of the above ranges.

* * * * *